United States Patent [19]

Weaver

[11] 4,128,982

[45] Dec. 12, 1978

[54] MEANS AND METHOD OF TILED SURFACE CONSTRUCTION

[76] Inventor: Daniel E. Weaver, 717 Salem Ct., San Diego, Calif. 92109

[21] Appl. No.: 859,038

[22] Filed: Dec. 9, 1977

[51] Int. Cl.[2] ..... E04F 13/08

[52] U.S. Cl. ..... 52/367; 52/389; 52/746; 52/747

[58] Field of Search ..... 52/35, 314, 367, 364, 52/371, 746, 747, 287, 384, 388, 389, 390; 156/71

[56] References Cited

U.S. PATENT DOCUMENTS

| | | | |
|---|---|---|---|
| 1,704,105 | 3/1929 | Sauer | 52/367 X |
| 2,272,162 | 2/1942 | Lackey | 52/367 X |
| 2,787,902 | 4/1957 | Primus | 52/314 |
| 3,398,494 | 8/1968 | Larson | 52/371 |
| 3,496,694 | 2/1970 | Hicks et al. | 52/746 |
| 3,953,268 | 4/1976 | Dillon | 52/371 X |
| 3,992,825 | 11/1976 | May | 52/747 X |

*Primary Examiner*—J. Karl Bell

*Attorney, Agent, or Firm*—Ralph S. Branscomb

[57] ABSTRACT

A means and method of wall construction utilizes plastic diamond mesh and permanently inset float strips imbedded in the setting bed for the ceramic tile.

11 Claims, 4 Drawing Figures

MEANS AND METHOD OF TILED SURFACE CONSTRUCTION

BACKGROUND OF THE INVENTION

The invention is in the field of constructing tile walls or horizontal counters and the like wherein the tile is installed over an existing structural surface.

Using the example of a vertical existing wall surface such as behind a bath tub or sink, the existing method of installing the tile is more or less as follows. First, tar paper or other impermeable membrane is put against the wall if the existing wall is not of a certain water resistant type. Then, a stiff awkward metal netting material called diamond mesh is placed over the tar paper and tacked through to the existing structural surface.

Then a pair of vertical swaths of mortar are laid from top to bottom of the wall to be tiled and a "float strip" is imbedded in each of these swaths.

The float strips are plumbed to insure that they are vertical within fairly close tolerances and they are adjusted in the mortar to insure this. The mortar in these swaths is of a thickness to permit plumbing to overcome any irregularities in the verticalness of the existing structure.

According to existing practice, at this stage mortar is "floated" between and around the float strips and screeded off with a straight-edge against the float strips so that the entire wall will be as vertical as the float strips which have been carefully plumbed. After the entire structure has been covered with mortar to form a "settiing bed" for the subsequent installation of the tile, the float strips, which are merely wooden laths, are pulled out of the mortar and the rectangular channels that they left in the mortar are then filled with mortar and troweled flat, and the float strips are washed off and saved for the next floating. Now that this setting bed or layer of mortar is complete, the tile is applied with special cements to the vertical mortar surface and the wall is finished.

The present invention is directed toward two aspects of this process which require improvement, the first being the use of metal diamond mesh referred in the trade as metal lath, and the other being the unnecessary effort involved in removing and cleaning the float strips and filling the channels they have left.

SUMMARY OF THE INVENTION

According to the present invention the basic process outlined above remains the same with the exception that the diamond mesh metal lath is replaced by a diamond mesh plastic lath, and the float strips are no longer removed and washed but are left intact as an integral part of the wall.

The advantages of utilizing a plastic diamond mesh are multi-fold. Because of the humid areas in which tile walls are often put, the metal lath begins to rust very quickly after installation and contributes to the rapid deterioration of the wall supporting structure.

In addition, the diamond mesh has very sharp points and is very difficult to cut with tin snips and install without somehow in the process winding up with multiple cuts and scratches.

The flexible nature of the plastic mesh makes it easier to transport and store and its shelf life is indefinite as it doesn't rust.

The permanent float strips will be described in more detail below and differ from existing float strips in that they can be made of plastic and have large openings occupying the majority of their volume to both cut material costs and provide voids for the mortar to fill so that a strong supporting surface is supplied to the subsequently applied tile.

DETAILED DESCRIPTION OF THE PREFERRED EMBODIMENT

Figure 1:
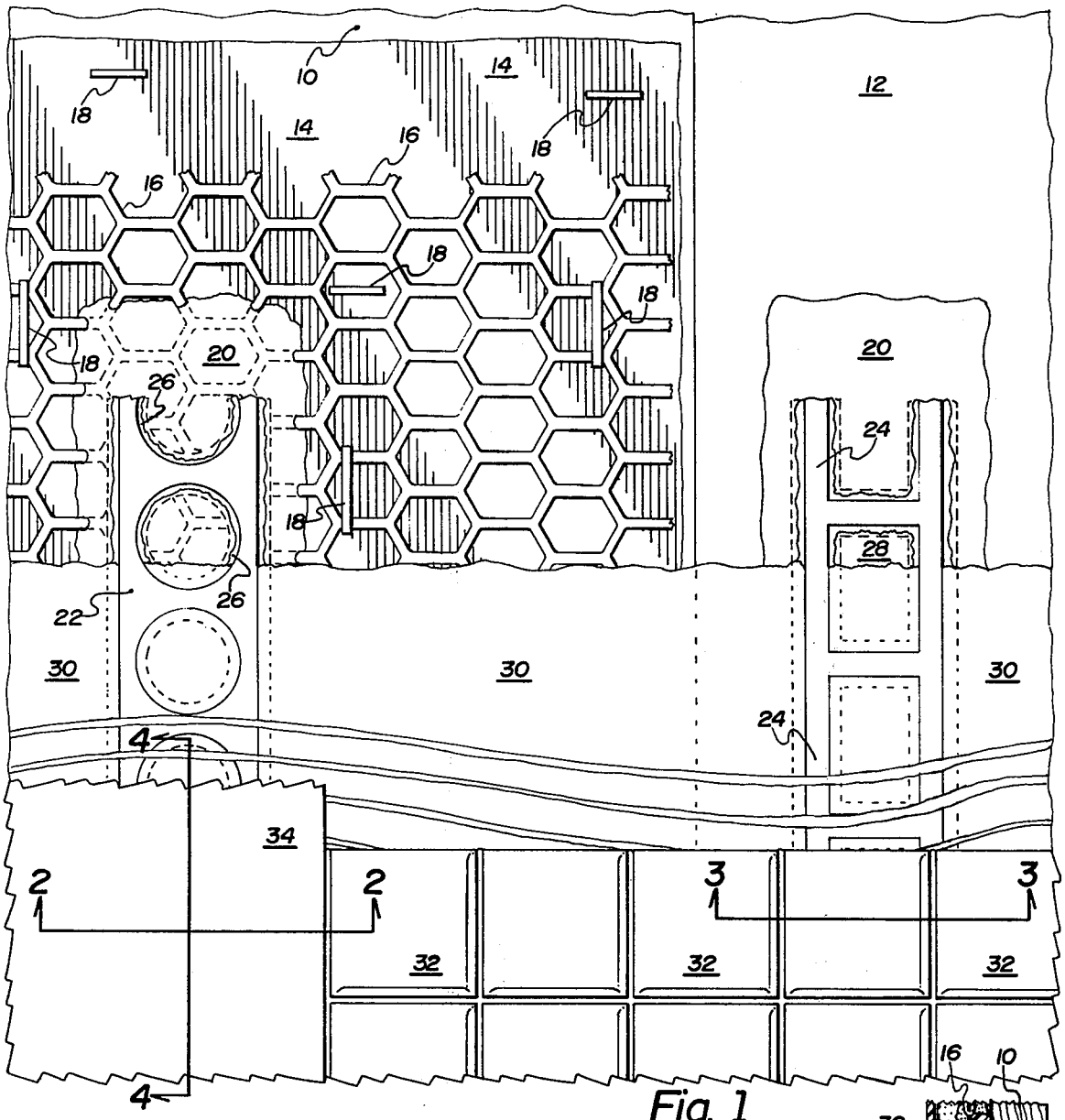
FIG. 1 is an omnibus partially cut away view of two somewhat different wall constructions in their different stages of completion.

FIG. 1 is an omnibus view showing two different types of wall construction in the various different stages of completion. In both methods the starting point is an existing vertical wall, one, indicated at 10 being drywall or wood and requiring the installation of an impermeable membrane, and the other being plaster, greenboard or the like, indicated at 12, which does not require a tarpaper or impermeable barrier. Other types of wall material may be used, and in fact the entire method may be applied to a horizontal surface, but the structural surfaces 10 and 12 will suffice to represent two somewhat different methods of installing the ceramic tile.

Over the surface 10 a layer of tarpaper 14 or polyethyline sheeting is laid. Over this layer is diamond mesh 16 which in the prior art was metallic, but in the present invention is a flexible plastic. This diamond mesh, which incidentally could have other than the particular netting configuration shown, is stapled at 18 or otherwise fastened to the structural surface 10.

Turning now briefly to the structural member 12 which does not require the impermeable membrane, this wall structure may also be covered without the use of diamond mesh, and this alternative is shown in FIG. 1.

Regardless whether diamond mesh and tarpaper are used, the next step in the wall construction process involves the laying of at least two vertical swaths 20 of mortar. Although terminating short of the top of the wall in FIG. 1 to illustrate the underlying structure, these swaths would ordinarily run the entire height of the wall to be covered.

Into each of these swaths of mortar, which may be on the order of an inch thick, is imbedded a float strip such as those illustrated at 22 and 24. These two different types of strips are representative of a family of structures which could be designed to accomplish the desired result.

Figure 2:
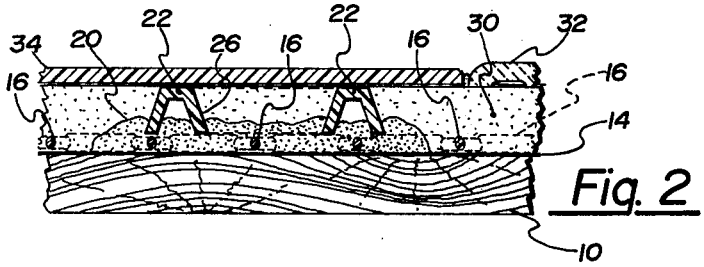
FIG. 2 is a sectional view taken through the lath of FIG. 1 along the line 2—2.
Figure 4:
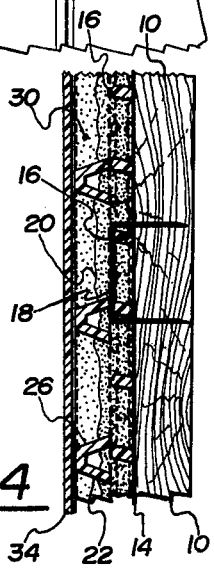
FIG. 4 is a sectional view taken across line 4—4 of FIG. 1.

The strip 22 is provided with a series of large diameter circles 26, and as can be seen from FIGS. 2 and 4 this type of strip is a hollow shell which would require a fairly small amount of plastic. Mortar would seep in through the holes and into the hollow part of the plastic shell for a very strong level of adhesion.

Figure 3:
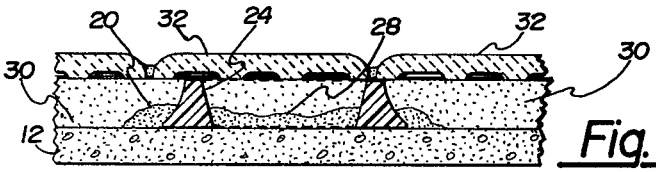
FIG. 3 is a sectional view taken along line 3—3 of FIG. 1.

Float strip 24 on the other hand is solid in the sense that the parallel side members are not hollowed, and the central openings 28 are rectangular. The parallel side edges of either float strip may be bevelled or hollowed as shown in FIGS. 2 and 3 to permit a better purchase of the mortar on these strips.

Turning again to the method of construction, once the strip is imbedded into the swath 20, it is plumbed with a level to insure it is vertical within close tolerance. If it is not, it is pressed into the swath deeper in the appropriate places so that it becomes vertical.

After this has been accomplished, the wall has a pair of spaced vertical float strips and the next step in the process is to "float" a setting bed of mortar between, and outside of the float strips. A straight edge is used to screed the mortar until a perfectly flat and vertical mortar bed is constructed, and meanwhile the openings in the center of the float strips are filled with mortar so that when the tile is subsequently applied to the setting bed over the float strips it will be secure because of the mortar in the center of the float strips which passes through to the supporting surface or the diamond mesh. The bed is then touched up smoothly.

Now that the mortar support base is flat and vertical, the appropriate cement or bonding compound 30 can be applied and then the tile 32 laid and subsequently grouted. As an alternative to laying ceramic tile a plastic sheet is shown at 34 to indicate that in fact any wall surfacing composition could be used, although the process primarily is aimed toward the construction of ceramic tile walls and other surfaces.

By the use of the flexible plastic diamond mesh and the permanently installed plastic float strips a significant reduction in the cost of ceramic tile installation is achieved due to reduced material and labor costs. Clearly by leaving the float strips installed rather than removing them and filling the void, a considerable amount of time is saved, and the use of an alternative to the wire diamond mesh, which is extremely awkward to work with because of its sharp points and edges and generally inflexible nature also saves time as well as prevents the otherwise inevitable scratching and irritation of the workers.

I claim:

1. A synthetic float strip for floating a setting bed on a structural surface for a tile wall, said strip comprising:

(a) an elongated flat body;

(b) said body having a plurality of openings passing through the thickness to permit exposed surfacedefining mortar in said openings to contact said structural surface;

(c) said body having a substantially smooth, flat front surface to serve as a guide for screeding board; and (d) at least a portion of the perimeter of said body being bevelled to provide a positive purchase for screeded mortar.

2. A strip according to claim 1 wherein said openings are circular, more than half as wide as said strip, and flaired outwardly to provide an expanded purchasing surface to subsequently applied tile bonding compound.

3. A method of constructing a wall on an existing structural surface comprising:

(a) applying a pair of spaced swaths of mortar to said structural surface;

(b) imbedding a pair of permanent float strips in said swaths of mortar;

(c) applying a layer of mortar between said permanent float strips and screeding said layer to the level of said float strips, using said float strips as screeding guides, to define a setting bed; and (d) applying the final wall surfacing composition to said setting bed covering said float strip.

4. A method according to claim 3 wherein said float strips each contain numerous openings passing through the thickness thereof and step C includes substantially filling said openings.

5. A method according to claim 4 wherein said float strips are molded in plastic and have flaired edges, and step C includes covering said flaired edges with mortar.

6. A method according to claim 3 and including the step of fastening a layer of diamond mesh lath to said structural surface prior to step A, whereby steps A and C include applying mortar over said mesh.

7. A method according to claim 6 wherein said mesh is composed of at least semi-flexible and non-abrasive material to permit the easy handling thereof.

8. A method according to claim 7 wherein said mesh is of petro-chemical composition.

9. A claim according to claim 8 and further including the step of applying an impermeable layer to said structural surface prior to fastening said mesh, said mesh being fastened to said structural surface through said impermeable layer with staples.

10. A method according to claim 3 and further including the step of plumbing said float strips prior to step C.

11. A method according to claim 3 wherein step D comprises covering said setting bed having the float strips therein with cement and laying ceramic tile in said cement.

* * * * *